US010550526B2

(12) United States Patent
Bennett et al.

(10) Patent No.: US 10,550,526 B2
(45) Date of Patent: Feb. 4, 2020

(54) FASTENING SYSTEM

(71) Applicant: CH3 Solutions, LLC, Dalton, GA (US)

(72) Inventors: Ron Bennett, Dalton, GA (US); Steve White, Jr., Dalton, GA (US)

(73) Assignee: CH3 SOLUTIONS, LLC, Dalton, GA (US)

( * ) Notice: Subject to any disclaimer, the term of this patent is extended or adjusted under 35 U.S.C. 154(b) by 0 days.

(21) Appl. No.: 15/467,184

(22) Filed: Mar. 23, 2017

(65) Prior Publication Data

US 2017/0275891 A1 Sep. 28, 2017

Related U.S. Application Data

(60) Provisional application No. 62/312,604, filed on Mar. 24, 2016.

(51) Int. Cl.
*E01C 13/04* (2006.01)

(52) U.S. Cl.
CPC ..... *E01C 13/04* (2013.01)

(58) Field of Classification Search
CPC ..... E04F 15/02044; E04F 15/02177; E04F 15/02183; E04F 15/105; E04F 15/02194; E04F 15/10; E04F 15/22; E04F 15/02005; E04F 15/02172; E04F 19/061; E04F 19/066; E04F 19/063; E04F 19/062; E04F 19/065; E04F 19/067; E01C 13/04
See application file for complete search history.

(56) References Cited

U.S. PATENT DOCUMENTS 2,644,977 A * 7/1953 June ..... A47G 27/045 16/7
2,788,551 A * 4/1957 Hildreth ..... E06B 1/70 49/467
2,980,943 A * 4/1961 Calandro ..... A47G 27/0462 16/16
2,996,751 A * 8/1961 Roby ..... E04F 19/06 16/16
3,411,977 A * 11/1968 Slater, Jr. ..... A47G 27/045 428/167
3,543,326 A * 12/1970 Rohrberg ..... A47G 27/045 16/16
3,909,996 A * 10/1975 Ettlinger, Jr. ..... E01C 5/20 52/177
4,187,656 A * 2/1980 Lutz ..... B44C 7/022 16/16

(Continued)

*Primary Examiner* — James M Ference
(74) *Attorney, Agent, or Firm* — Lathrop Gage L.L.P.

(57) ABSTRACT

A fastening system comprises a fastening mechanism having a transition member and a ramp member. The transition member has a lower planar element, and an upper planar element, and a central portion disposed therebetween. The ramp member has a lower planar component, a first upper planar component, a forwardly angled component disposed between the lower planar component and the first upper planar component, and a backwardly angled component extending outwardly from the first upper planar component. The ramp member upper planar component is disposed above the transition member upper planar element, and the transition member lower planar element is at least partially disposed above the ramp member lower planar member.

12 Claims, 9 Drawing Sheets

(56) References Cited

U.S. PATENT DOCUMENTS 4,468,910 A * 9/1984 Morrison ..... A01K 1/0157 404/36
4,497,858 A * 2/1985 Dupont ..... A47L 23/24 404/41
4,893,449 A * 1/1990 Kemper ..... E04F 15/02005 52/391
5,628,160 A * 5/1997 Kung ..... E01C 5/20 403/11
5,630,304 A * 5/1997 Austin ..... E04F 15/10 428/57
5,657,598 A * 8/1997 Wilbs ..... A47G 27/045 403/122
5,865,004 A * 2/1999 Mitchell ..... E01C 5/005 403/294
6,345,480 B1 * 2/2002 Kemper ..... E04F 19/061 403/118
6,357,192 B1 * 3/2002 Schluter ..... E04F 19/061 52/287.1
6,505,444 B1 * 1/2003 Johnson ..... A47L 23/24 52/177
6,526,705 B1 * 3/2003 MacDonald ..... E04F 15/02 428/157
6,718,588 B1 * 4/2004 Frederiksen ..... B65G 69/30 14/69.5
6,745,534 B2 * 6/2004 Kornfalt ..... E04F 15/04 52/395
6,802,159 B1 * 10/2004 Kotler ..... E01C 5/20 404/35
7,591,605 B2 * 9/2009 Jonasz ..... E01F 9/529 404/15
7,594,778 B2 * 9/2009 Baranoff ..... E01C 9/086 404/73
7,908,819 B2 * 3/2011 Neuhofer, Jr. ..... E04F 19/061 52/396.04
8,087,209 B2 * 1/2012 Sondermann ..... E04F 19/066 52/288.1
8,128,311 B2 * 3/2012 Son ..... A63C 19/04 403/326
8,186,118 B2 * 5/2012 Neuhofer ..... E04F 19/061 52/312
8,245,474 B2 * 8/2012 Schacht ..... E04F 19/061 52/100
8,266,865 B2 * 9/2012 Neuhofer, Jr. ..... E04F 19/061 52/512
8,288,652 B2 * 10/2012 Lubanski ..... H02G 9/025 104/275
8,388,261 B1 * 3/2013 Lane ..... E01C 9/08 404/25
8,572,919 B1 * 11/2013 Neill ..... E04F 19/061 52/466
8,651,770 B2 * 2/2014 Lancaster ..... E02B 3/122 405/16
8,844,231 B2 * 9/2014 Urban, Jr. ..... B32B 1/00 16/7
8,966,847 B2 * 3/2015 Kessler ..... E04B 1/6804 52/395
2002/0095895 A1 * 7/2002 Daly ..... E04F 19/062 52/464
2002/0129452 A1 * 9/2002 Pelosi, Jr. ..... E04F 11/002 14/69.5
2002/0144364 A1 * 10/2002 Anderson ..... E01C 9/083 14/69.5
2002/0157331 A1 * 10/2002 Peart ..... E04F 15/02411 52/220.2
2002/0189176 A1 * 12/2002 Stegner ..... E01C 5/20 52/177
2003/0154678 A1 * 8/2003 Stanchfield ..... E04F 15/02005 52/468
2005/0108968 A1 * 5/2005 Forster ..... E01C 5/20 52/578
2005/0252109 A1 * 11/2005 Fuccella ..... E04F 15/10 52/177
2006/0016136 A1 * 1/2006 Moller, Jr. ..... E04F 15/10 52/177
2006/0070314 A1 * 4/2006 Jenkins ..... E01C 13/045 52/177
2006/0150565 A1 * 7/2006 Schacht ..... E04F 15/02005 52/716.1
2006/0272252 A1 * 12/2006 Moller, Jr. ..... E01C 5/20 52/384
2006/0283118 A1 * 12/2006 Moller, Jr. ..... E01C 5/20 52/403.1
2006/0283125 A1 * 12/2006 Moller, Jr. ..... E01C 5/20 52/578
2007/0094969 A1 * 5/2007 McIntosh ..... E04F 15/02044 52/386
2007/0289244 A1 * 12/2007 Haney ..... E01C 5/20 52/539
2008/0216437 A1 * 9/2008 Prevost ..... E01C 13/08 52/589.1
2009/0031658 A1 * 2/2009 Moller, Jr. ..... E01C 5/20 52/403.1
2009/0106918 A1 * 4/2009 Van Roosmalen .... A61G 3/061 14/69.5
2009/0165414 A1 * 7/2009 Burk ..... E04F 15/225 52/403.1
2009/0188035 A1 * 7/2009 Luxton ..... A47K 3/281 4/604
2009/0235605 A1 * 9/2009 Haney ..... E01C 5/20 52/588.1
2012/0110939 A1 * 5/2012 Sondermann ..... E04F 19/061 52/468
2017/0275891 A1 * 9/2017 Bennett ..... E04F 15/02044

* cited by examiner

FASTENING SYSTEM

CROSS-REFERENCE TO RELATED APPLICATIONS

This application claims priority to U.S. Provisional Patent Application No. 62/312,604, filed Mar. 24, 2016, titled Tile Fastening System, the entire contents of which are incorporated herein by reference.

BACKGROUND

Recreational tiles are frequently used as flooring in a number applications ranging from athletic flooring to playground surfaces and beyond. Among other uses, tiles may be used as a court surface, for example, or as a sub-surface to which synthetic turf may be attached. Recreational tiles are often made of plastic, but may also be manufactured from other materials. One such tile is illustrated in U.S. Pat. No. 5,628,160 to Küng. Recreational tiles have many advantages over hard surfaces such as concrete, including the ability of the tiles to provide a more forgiving surface which may help to prevent player injuries.

Typically, a plurality of tiles is connected together via a tile fastening mechanism in order to form the desired surface. To prevent the surface from shifting from its intended position, several of the tiles may be secured to the ground surface (e.g., concrete, rock, etc.) using pins. However, the tiles naturally expand and contract as the temperature fluctuates, e.g., due to the freeze/thaw cycle, or as a result of pressure changes on the tiles (e.g., movement across the tiles). As the tiles expand and contract, the surface naturally shifts, if only slightly. The pins, which are intended to prevent the shifting, cause the tiles to buckle. Occasionally, the pin will rip through the tile to which it is secured. Tiles may be damaged as a result. If a damaged tile is in the middle of the surface, it can take significant effort and cost to remove the old tile and replace it with a new one.

In addition to the broken tiles due to flawed tile-to-surface fastening mechanisms, tile systems are prone to thievery. Tile systems are not inexpensive to install. The tiles themselves require expensive molding and superior materials, making the tiles costly to produce, and therefore, buy. Moreover, the surface upon which the tiles are installed must be properly prepared, requiring earth movers to ensure a flat surface, and laying rock and/or concrete so that the tiles are laid upon a hard surface. Due to the expense of putting in a tile system, many people who would otherwise like to have such a system cannot afford one. Unfortunately, due to the fastening mechanisms currently employed, stealing tiles from existing systems is quite easy. Thieves may simply walk up to a tile system and unsnap one or more tiles from the system.

It would therefore be desirable to have a tile fastening system that allows the tiles to flex and shift naturally without causing damage to the tiles, and to prevent thieves from being able to steal tiles from existing systems.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a tile fastening system includes a tile fastening system comprises a fastening mechanism having a transition member and a ramp member. The transition member has a lower planar element, and an upper planar element, and a central portion disposed therebetween. The ramp member has a lower planar component, a first upper planar component, a forwardly angled component disposed between the lower planar component and the first upper planar component, and a backwardly angled component extending outwardly from the first upper planar component. The ramp member upper planar component is disposed above the transition member upper planar element, and the transition member lower planar element is at least partially disposed above the ramp member lower planar member.

In another embodiment, a fastening system comprises a tile having a tile surface and disposed above a subsurface, and a fastening mechanism. The fastening mechanism includes a transition member and a ramp member. The transition member includes a lower planar element, and an upper planar element, and a central portion disposed between the lower planar element and the upper planar element. The ramp member has a lower planar component, a first upper planar component, a forwardly angled component disposed between the lower planar component and the first upper planar component, and a backwardly angled component extending outwardly from the first upper planar component. The ramp member lower planar member is disposed above the subsurface. The transition member upper planar element is substantially adjacent the tile surface. The ramp member upper planar member is disposed above the transition member upper planar element. And, the transition member lower planar element is at least partially disposed above the ramp member lower planar member. A fastener inserted through corresponding apertures in the transition member lower planar element and the ramp member lower planar component secures the fastening mechanism to the subsurface.

In still another embodiment, a fastening system includes a tile having a tile surface, the tile being disposed above a subsurface; and a fastening mechanism. The fastening mechanism includes a transition member and a ramp member. The transition member has a lower planar element, and an upper planar element, and an angled central portion disposed between the lower planar element and the upper planar element. The ramp member has a lower planar component, a first upper planar component, a forwardly angled component disposed between the lower planar component and the first upper planar component, a backwardly angled component extending outwardly from the first upper planar component, and a second upper planar component extending inwardly from the backwardly angled component, a first space being formed between the first upper planar component and the second upper planar component. The ramp member lower planar component is disposed above the subsurface, the transition member upper planar element is disposed in the first space; and the transition member lower planar element is at least partially disposed above the ramp member lower planar member.

In still yet another embodiment, a fastening system includes a fastening mechanism having a top surface; a forwardly angled portion extending from a back side of the top surface; a backwardly angled portion extending from a front side of the top surface; and respective bottom surfaces being formed beneath the forwardly and backwardly angled portions. A tongue extends from a first side of the top surface, and the tongue is offset from the top surface, and a groove is formed under a second side of the top surface. A fastener mount extends from a first side of the bottom surface of the forwardly angled portion; and a channel is formed in a second side of the bottom surface of the forwardly angled portion.

BRIEF DESCRIPTION OF THE DRAWINGS

The drawings illustrate exemplary embodiments of the invention and various objects and features thereof. Reference to the drawings may, as a part of the specification, aid in a complete understanding of the invention.

DETAILED DESCRIPTION

Figure 1:
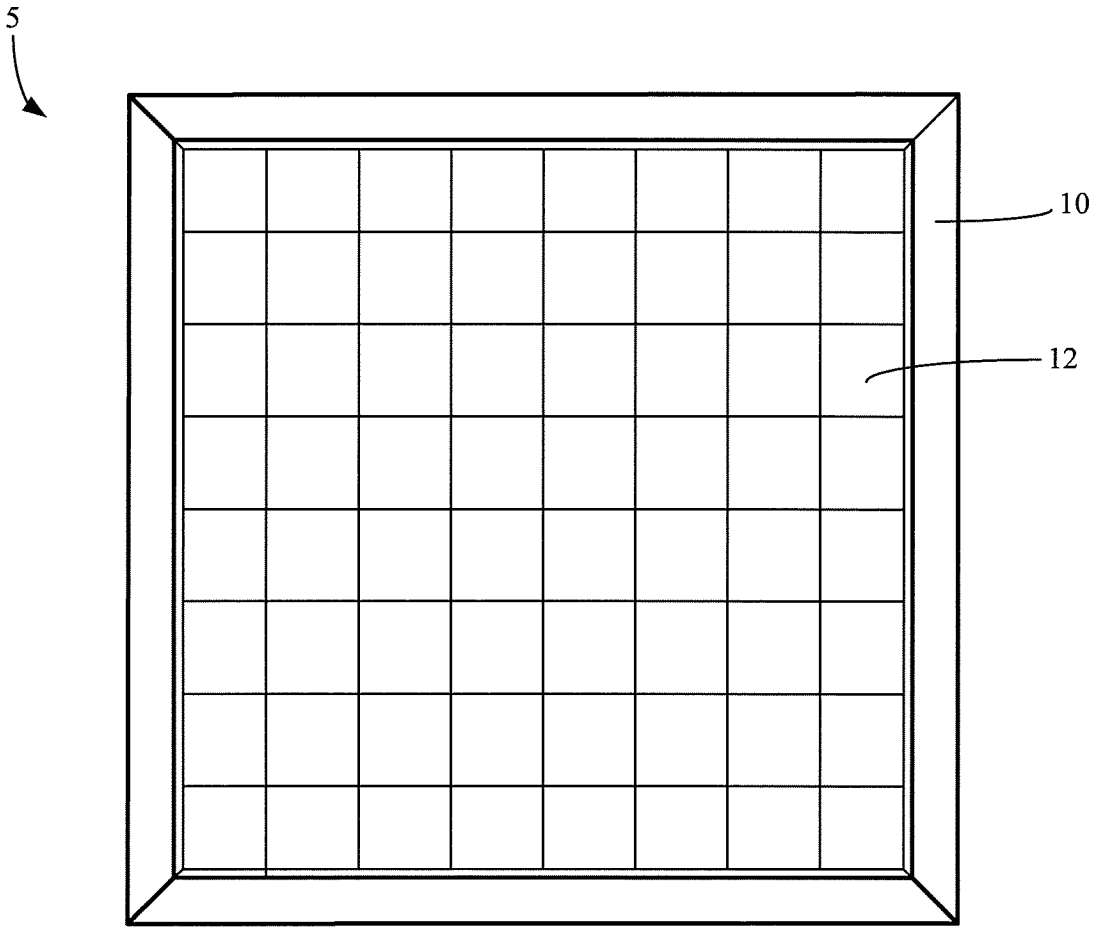
FIG. 1 is a top view of a tile system incorporating a tile fastening mechanism according to an embodiment of the invention.
Figure 1A:
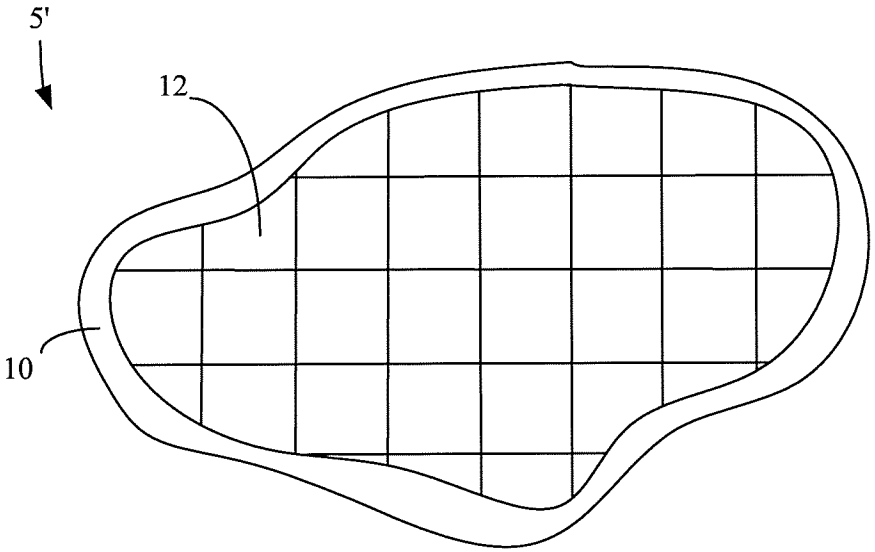
FIG. 1A is a top view of a tile system incorporating a tile fastening mechanism according to another embodiment of the invention

FIGS. 1-4 illustrate various embodiments of the tile fastening system 100. Beginning with FIG. 1, a tile system 5 includes a plurality of tiles 12 and a fastening mechanism 10. The tile system 5 illustrated in FIG. 1 includes a square 8×8 grid of tiles 12 arranged in a simple square. Those of skill in the art shall understand that tile systems 5 often come in a variety of shapes and sizes, and are not always (and in fact, are often not) a square surface. The fastening mechanism 10 may thus be adapted as necessary according to the various shape and size of the tile grid. FIG. 1A roughly illustrates a system 5' that incorporates a non-square grid of tiles 12 with a fastening mechanism 10 arranged thereabout.

Figure 2:
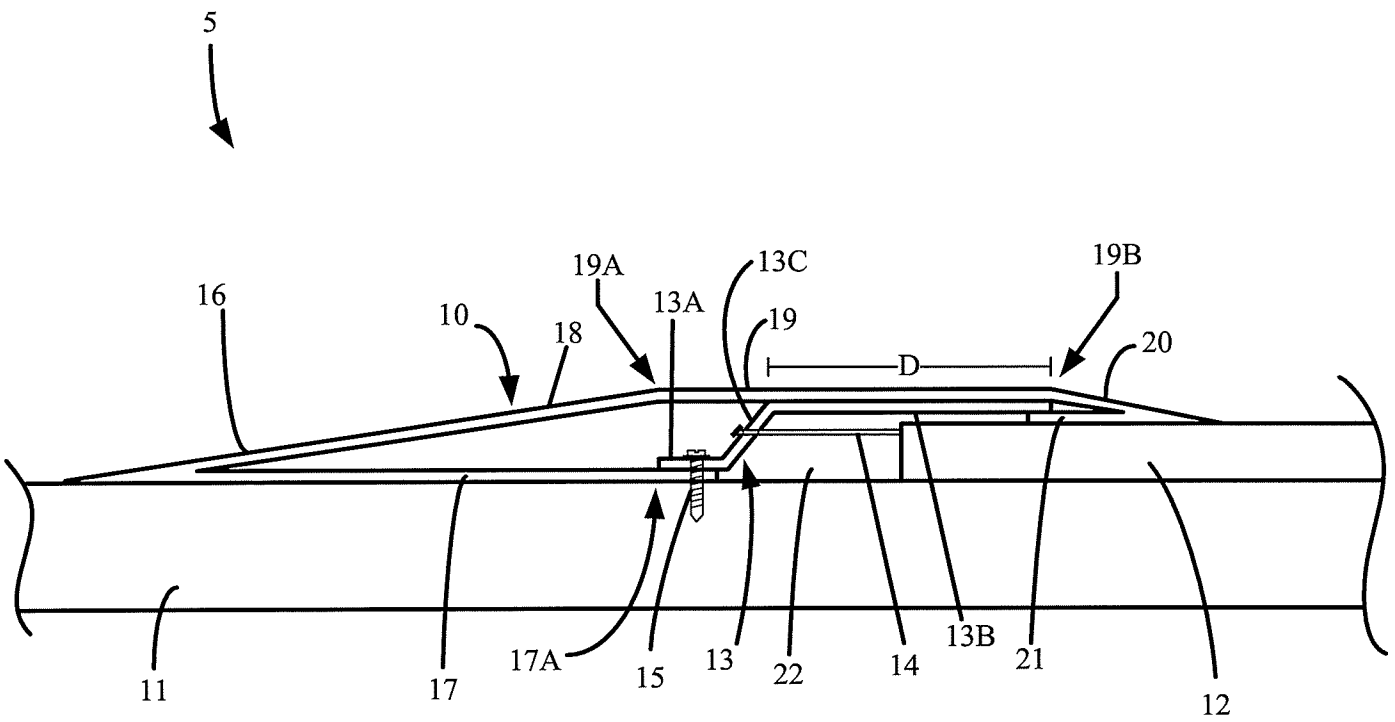
FIG. 2 is a side cross-section view of a tile fastening mechanism according to one embodiment of the invention.
Figure 3:
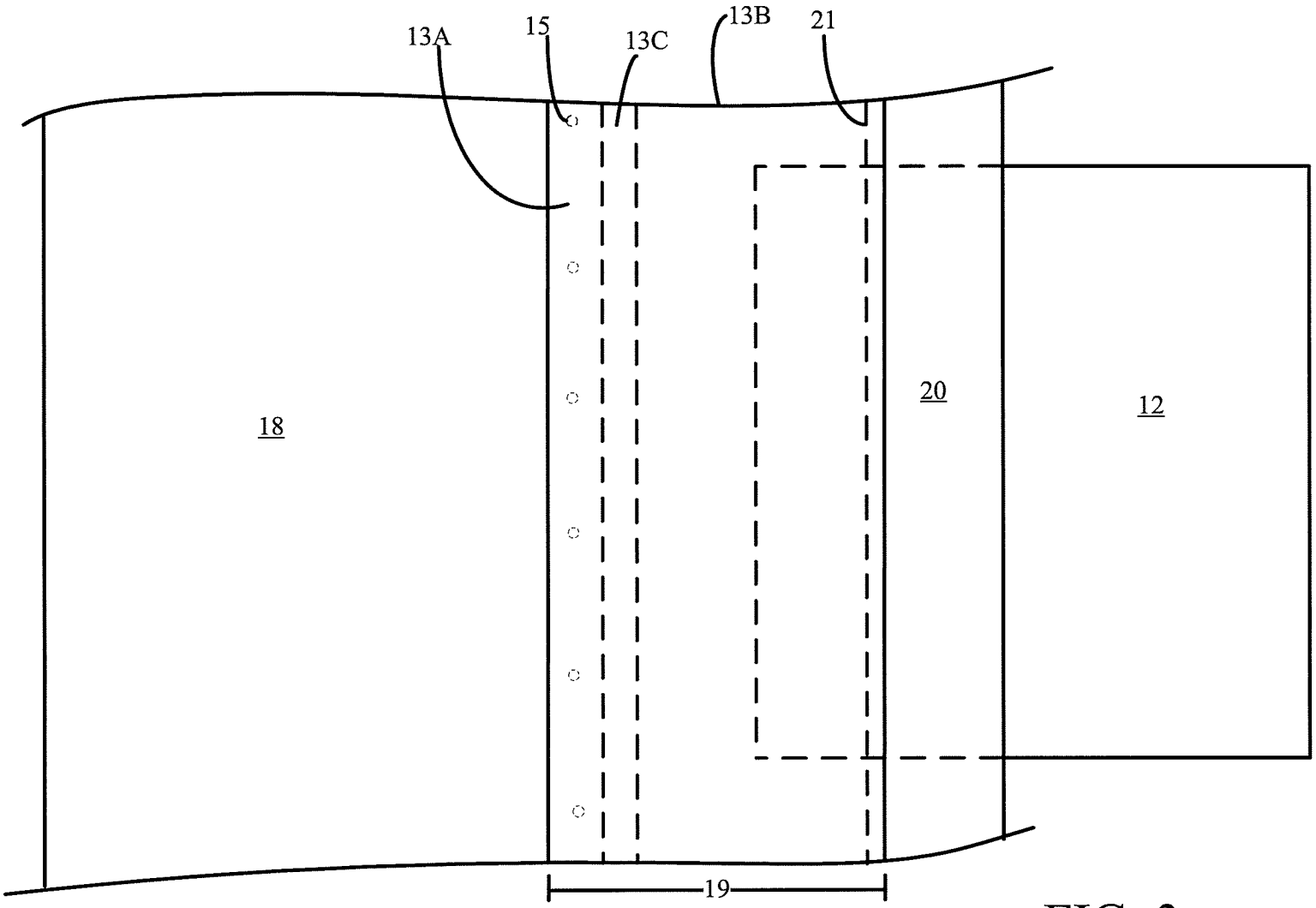
FIG. 3 is a top view of the tile fastening mechanism of FIG. 2.

Moving on to FIGS. 2 and 3, an embodiment of a tile system 5 having a fastening mechanism 10 engaged with one or more tiles 12. The fastening mechanism 10 and the tiles 12 are disposed on a prepared subsurface 11, such as concrete. The fastening mechanism 10 includes an inner transition member 13 and an outer ramp member 16.

The inner transition member 13 include a lower planar element 13A, an upper planar element 13B, and a central portion 13C disposed between the upper and lower planar elements 13B and 13A, respectively. The central portal 13C may be angled between the lower planar element 13A and the upper planar element 13B to form a space 22, which, as described in greater detail below, allows for expansion and contraction of the tile members 12. The upper and lower planar elements 13A and 13B may be substantially parallel to the top face of the subsurface 11.

The lower planar element 13A may have a length sufficient to receive a fastener 15, such as a tapcon or concrete nail. Other types of fasteners for anchoring the fastening mechanism 10 to the subsurface 11 may be used as shall be understood by those of skill in the art. The fastener 15 may be inserted through an aperture in the lower planar element 13A (and a respective aperture in a lower planar portion 17 of the ramp member 16) to secure the fastening mechanism 10 to the subsurface 11.

The upper planar element 13B extends a distance D sufficient to engage with the outer ramp member 16 and the edge or the tile 12 as described below.

The outer ramp member 16 includes a lower planar member 17, a first upper planar member 19, a second upper planar member 21, a forwardly angled member 18 disposed between the lower planar member 17 and the first upper planar member 19, and a backwardly angled member 20 disposed between the first upper planar member 19 and the second upper planar member 21. The lower planar member 17 sits atop the subsurface 11, and extends inwardly in a direction of the tile 12. An inside end 17A of the lower planar member 17 extends inwardly such that it engaged with the lower planar element 13A of the transition member 13. As noted above, a fastening mechanism 15 may be inserted through corresponding apertures in the lower planar element 13A of the transition member 13 and the lower planar member 17 of the ramp member 16 to secure the fastening mechanism 10 to the subsurface 11.

The first upper planar member 19 extends substantially horizontally along the transition member upper planar element 13B. A first edge 19A of the first upper planar member may extend beyond an outer edge of the transition member upper planar element 13B such that the forwardly angled member 18 has a slope of approximately 1:12, although other slopes may be acceptable or appropriate.

The backwardly angled member 20 extends downwardly at an angle from a second edge 19B of the first upper planar member 19 to meet up with the second upper planar member 21, which extends inwardly to form a space between the first upper planar member 19 and the second upper planar member 21. The second upper planar member 21 is disposed substantially atop the tile 12. The transition member upper planar element 13B is disposed in the space between the first upper planar member 19 and the second upper planar member 21.

Thus, as shown in FIG. 2, the tile 12 sits atop the subsurface 11. The fastening mechanism 10 is fastened to the subsurface 11 and engages with the tile 12 via the transition member 13 and the ramp member 16. The tile 12, however, is not fastened directly to the subsystem 12. The tile 12 may therefore expand and contract within the space 22 without buckling.

A probe gauge 14 may be inserted horizontally though an aperture in the angled element 13C. The probe gauge 14 may evaluate the position of the plastic tile 14. The probe gauge 14 may be configured to communicate (e.g., wirelessly) over a network to provide alerts, for example, when the tile(s) 12 have shifted a predetermined distance.

The forwardly and backwardly angled members 18 and 20, respectively, allow for a smooth transition from the tile surface 12 to the subsurface 11. In embodiments, the backwardly angled member 20 may be nearly imperceptible to a person walking atop the tile surface 12. Further, the ramp member 16 may thus be configured for compliance with the Americans with Disabilities Act of 1990 (ADA), as it will not be required to step up to access the tile surface 12.

Figure 4:
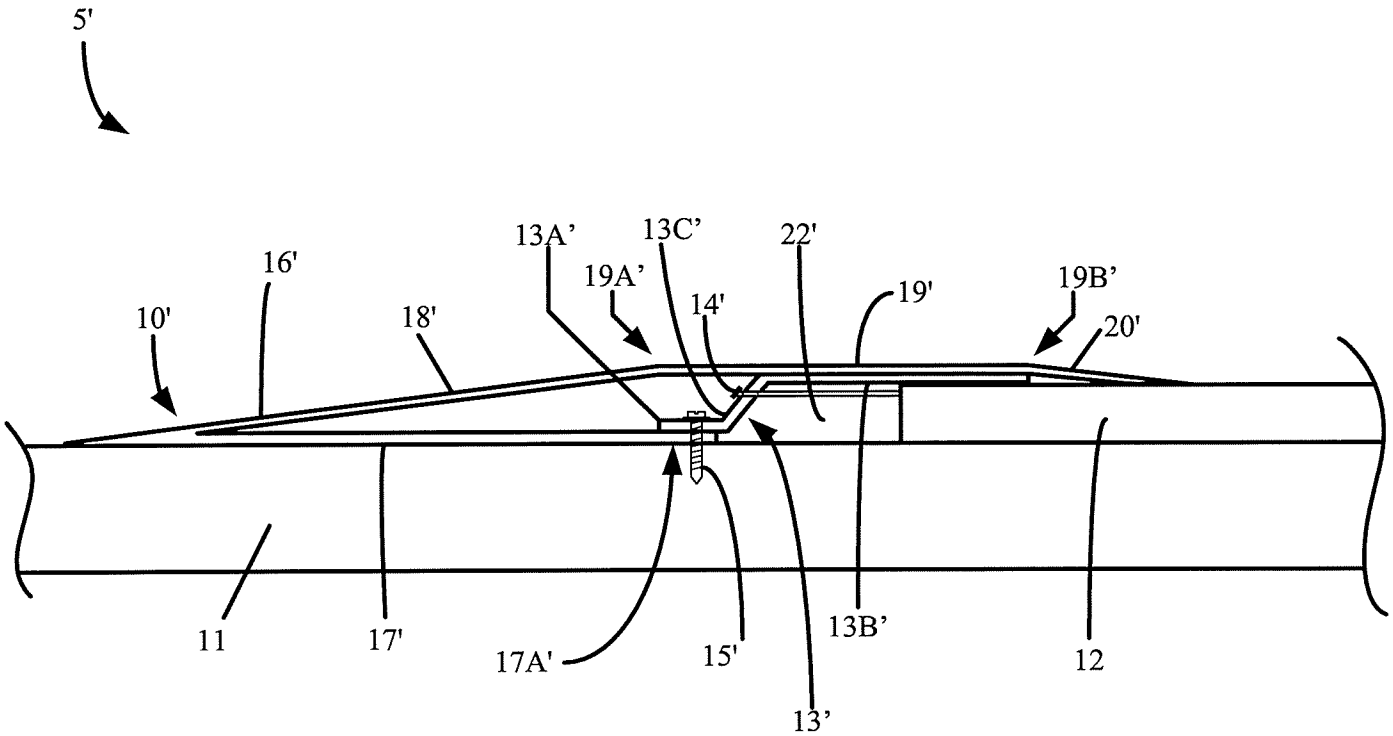
FIG. 4 is a side cross-section view of a tile fastening mechanism according to another embodiment of the invention.
Figure 5:
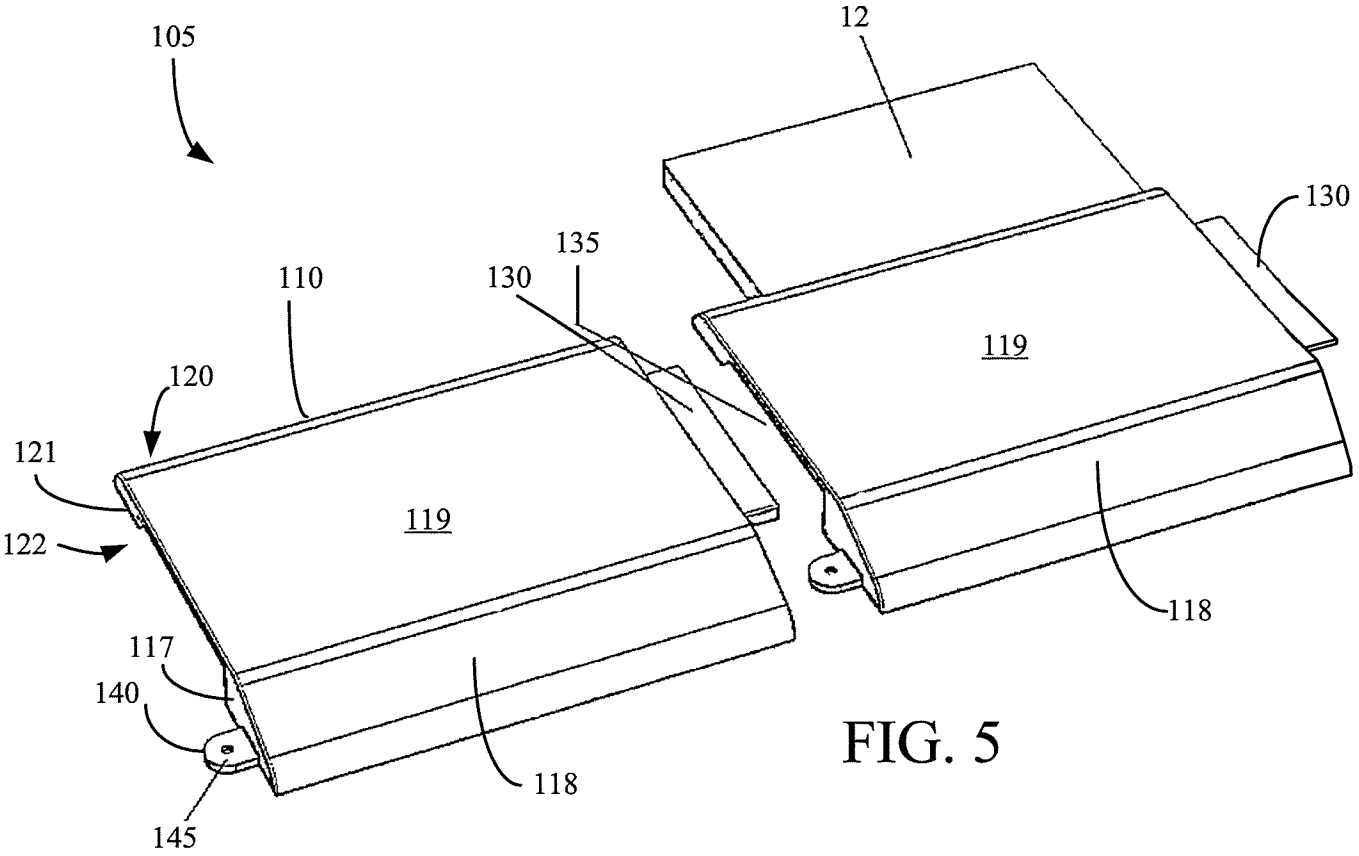
FIG. 5 is a perspective view of a tile fastening mechanism according to still another embodiment of the invention.
Figure 6:
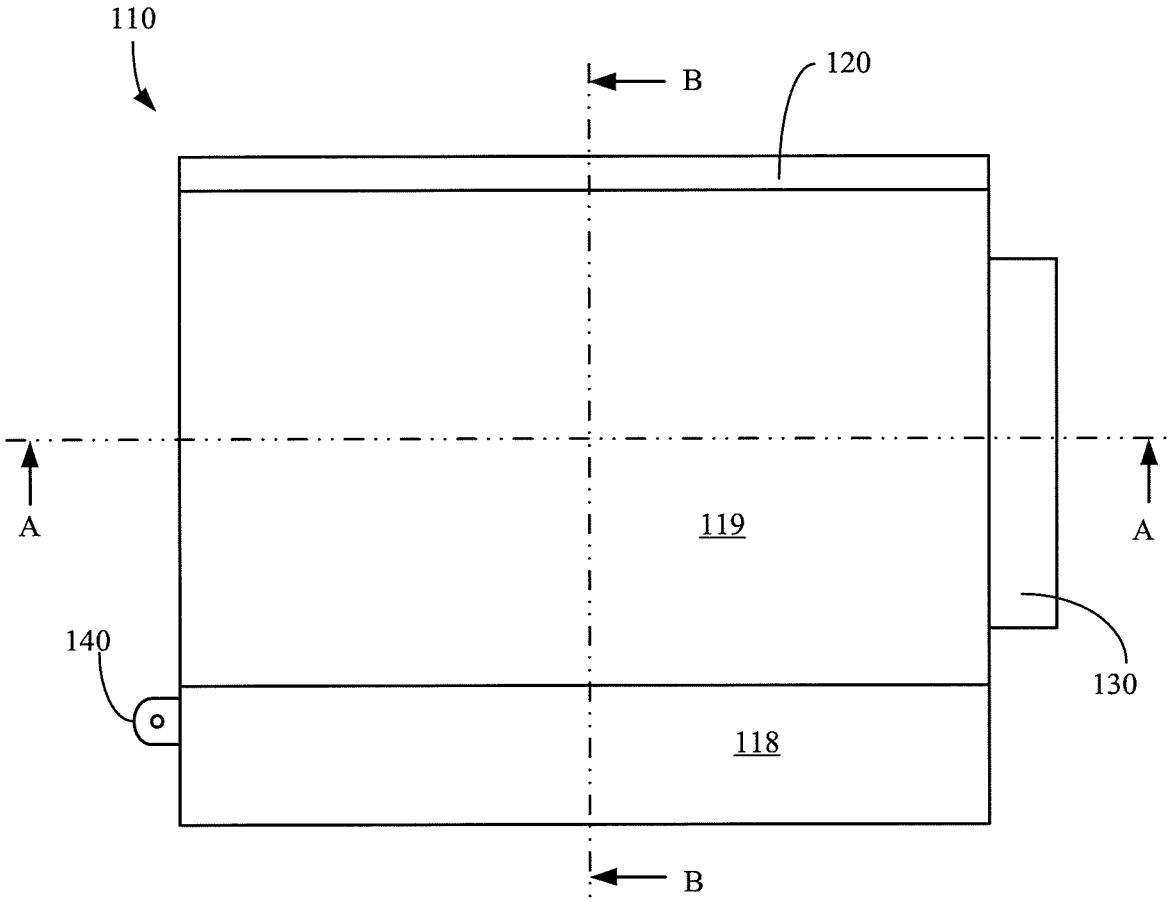
FIG. 6 is a top view of the tile fastening mechanism of FIG. 5.
Figure 7C:
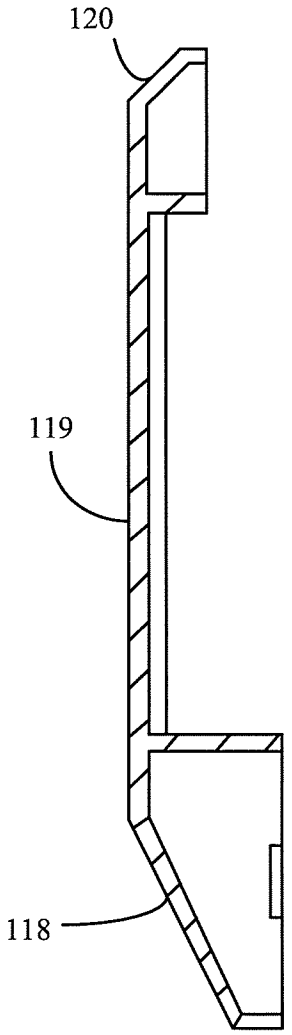
FIG. 7*c* is a section view along Section B-B of the tile fastening mechanism of FIG. 6.
Figure 7B:
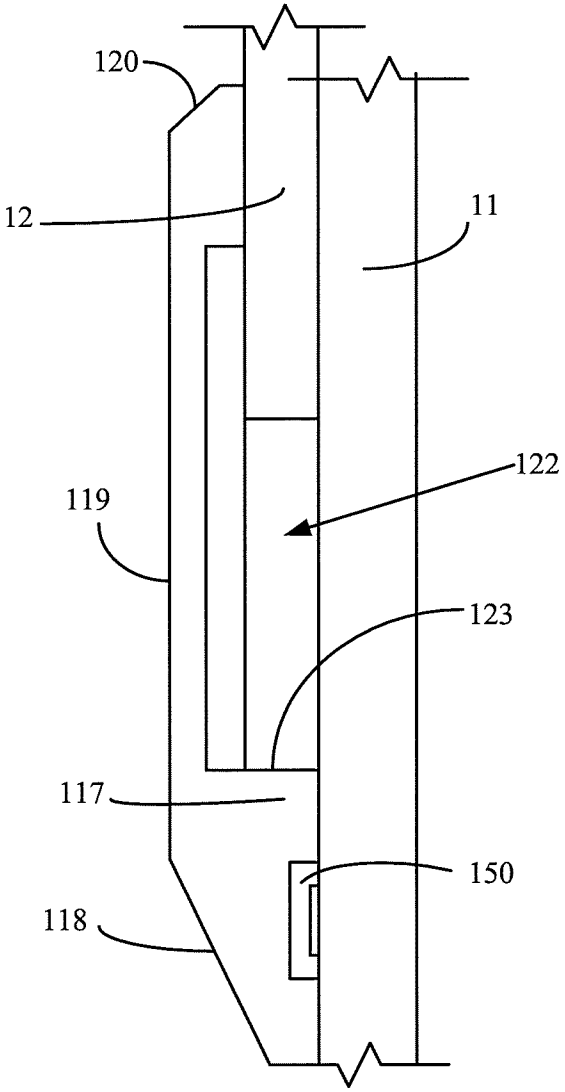
FIG. 7*b* is a right side view of the tile fastening mechanism of FIG. 5.
Figure 7A:
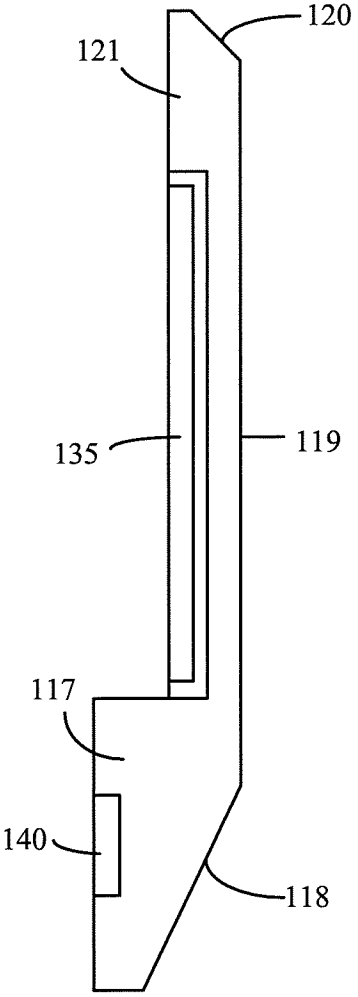
FIG. 7*a* is a left side view of the tile fastening mechanism of FIG. 5.
Figure 7D:
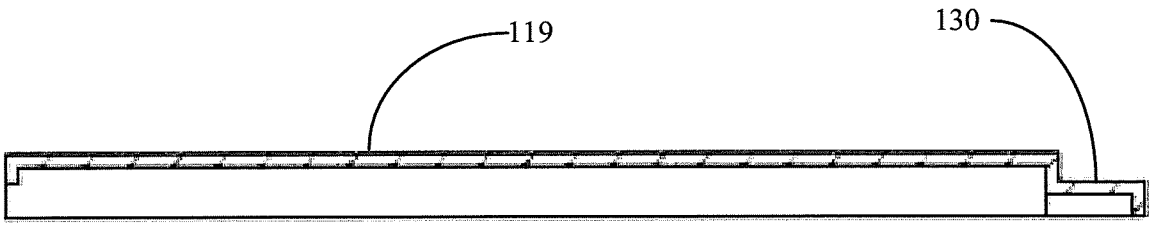
FIG. 7*d* is a section view along Section A-A of the tile fastening mechanism of FIG. 6.
Figure 7E:
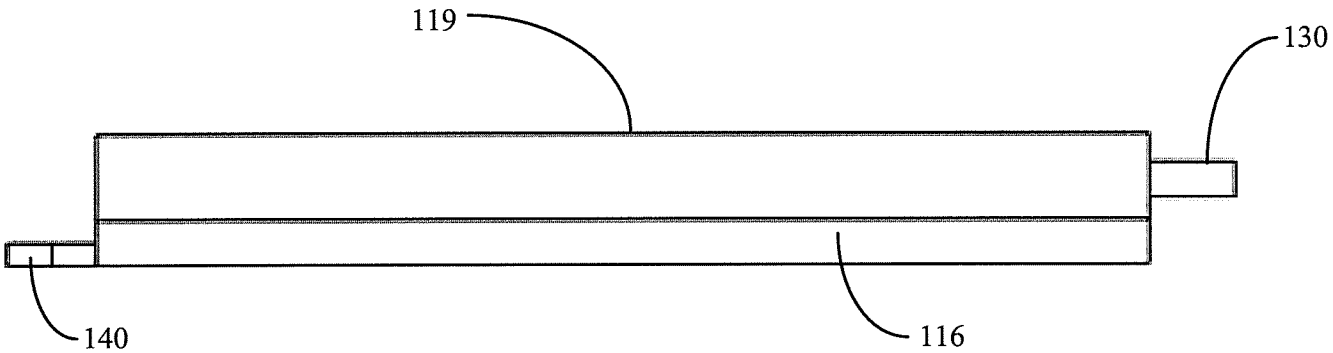
FIG. 7*e* is a front view of the tile fastening mechanism of FIG. 5.

FIG. 4 illustrates an alternative embodiment 5' of a fastening mechanism 10' which is substantially similar to fastening mechanism 10 except as shown as described. Corresponding numbers from FIG. 2 are given to similar elements in FIG. 4 (e.g., element 18 in FIG. 2 corresponds to element 18' in FIG. 4). As can be seen in FIG. 4, the ramp member 16' is nearly identical to the ramp member 16. Here, however, the ramp member 16' does not include a second upper planar member 21. The upper planar element 13B' is disposed directly on the top surface of the tile 12. The upper planar member 19' runs adjacent the upper planar element 13B', and the backwardly angled member 20' directly abuts the top surface of the tile 12.

In use, multiple transition members 13 and ramp members 16 may be provided around the entire edge of a tile surface 12 to keep the tiles in the desired location. The tiles 12 may snugly fit into the space 22 formed between the fastening mechanism 10 and the subsurface 11. The fastening mechanism 10 may impart an elastic force on the tile, which causes backwardly shaped component to press against the tile 12, as shown in the figures. However, the tiles 12 are allowed to expand and contract due to the opening 22 between the transition member 13, the subsurface 11, and the tile 12. As the upper planar element 13B of the transition member 13 extends beyond the edge of the tile 12 towards the center of the tile 12, the transition member 13 and the ramp member 16 remain in constant contact with the tile 12. However, the tiles cannot move away from the desired position due to the transition members 13 and the ramp members 16 being secured to the subsurface 11. Those of skill in the art will recognize that the flexibility that the disclosed fastening mechanism 10 gives to the tiles 12 is especially useful in areas where the freeze/thaw cycle may otherwise cause the tiles 12 to be in a constant shift away from the desired position.

Additionally, the fastening member 15 may be completely inaccessible once the system 5 is fully installed. Because the transition members 13 extend over the edge of the tile 12, the and the transition member 13 is secured to the subsurface 11 via an inaccessible fastening member 15, thieves will have difficulty reaching the edges of the tiles 12 in order to dismantle them from the outer edges. Therefore, once installed, it will be increasingly difficult to break apart the tiles 12. Thieves may thus be dissuaded from attempting to remove the tiles 12 from a system 5 incorporating the fastening mechanism 10 described herein.

The various components of the fastening mechanism 10 may be manufactured from any material. Particular materials, such as hard plastics or aluminum, may be preferable as understood by those of skill in the art. However, the materials are not limited to plastics.

FIGS. 5-7*e* illustrate still another embodiment 105 of the invention. Here, the fastening mechanism is a locking piece 110 configured to interact with other locking pieces 110 and tiles 12. Components of the locking piece 110 correspond with components of the fastening mechanism 10. For uniformity and brevity, reference numbers between 100 and 199 may be used to indicate parts generally corresponding to those discussed above numbered between 0 and 100 (e.g., surface 119 generally corresponds to surface 19), though with any noted or shown deviations.

The locking piece 110 may be manufactured as a single piece. Although many methods may be used as known to those of skill in the art, in one embodiment, the piece 110 may be molded (e.g., injection molded) using one or more materials such as a hard plastic. The locking piece 110 includes a top surface 119 extending substantially parallel to a subsurface. A forwardly angled portion 118 extends outwardly from the top surface 119 in a first direction, and a backwardly angled portion 120 extends outwardly from the top surface 119 in an opposing direction. The forwardly angled portion 118 includes a bottom surface 117 which extends inwardly under the forwardly angled portion 118 and abuts the subsurface. Likewise, the backwardly angled portion 120 includes a bottom surface 121 which extends inwardly under the backwardly angled portion 120 and abuts the surface of the tile 12. It shall be understood that the respective bottom surfaces 117 and 121 may be solid or hollowed out.

A space 122 (FIG. 7*b*) may be formed between the subsurface 11 and the bottom surface 121. The tile 12 is configured to fit within the space 122. The tile 12 may abut a front surface 123 of the bottom surface 117. Alternately, in order that the tile 12 may expand and contract due to changes in the environment (e.g., temperature, pressure, etc.), when installed, a gap (e.g., 1", 2", 3", etc.) may be formed between the wall 123 and the tile 12.

As noted above, each locking piece 110 is configured to interact with locking pieces 110 on both the right and left sides. To achieve such interact, each locking piece 110 has a tongue 130 extending from a side of the top surface 119 (e.g., the right side) and a corresponding groove 135 formed beneath the top surface 119 on the opposite side (e.g., the left side). The tongue 130 may be slightly offset from the top surface 119 such that it snugly fits into the groove 135 of a corresponding locking piece 110.

Each locking piece 110 is further configured to be secured to the subsurface 11. A fastening mount 140 may extend from one side (e.g., the left side) of the bottom surface 117 and may be configured so as to lay substantially flat against the subsurface. An aperture 145 may be formed in the mount 140 to receive a fastener (e.g., concrete screw, anchor, etc.). The locking piece 110 is thus secured to the subsurface by inserting a fastener through the aperture 145 and fastening as appropriate. A corresponding channel 150 may be formed into the other side (e.g., the right side) of the bottom surface 117 for receiving a fastening mount 140 of a corresponding locking piece 110. Therefore, the fasteners are covered up and inaccessible due to the installation of corresponding locking pieces 110. As understood by those of skill in the art, it may be beneficial to install locking pieces 110 in a clockwise direction around a grid of tiles 12.

The groove 135 and the channel 150 may allow for expansion and contraction of the locking pieces 110 due to, for example, changes in the environment. The tongue 130 and fastening mount 140 may be sufficiently sized such that even in extreme instances of expansion and contract, the various locking pieces 110 remain connected.

It shall be understood by those of skill in the art that additional pieces 110, such as corner pieces, may be similarly formed in order to connect two sides of locking pieces 110. Further, it shall be understood that in embodiments, it may be desirable for components to be joined together at the point of installation rather than formed as a single piece. For example, in embodiments, a tile 12 may need to be cut to length, which would require that the locking piece 110 is also cut to length. Here, it may be desirable for the channel 130 to run the entire length of a locking piece 110. A furrow may run along the bottom surface 117 which may generally correspond to the width of the mount 140. Once the locking piece 110 is cut to the appropriate length, the mount 140 may be secured (e.g., using an adhesive) in the furrow such that it extends outwardly to receive a fastener as described above. The furrow may additionally function as the channel 150.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations are of utility and may be employed within the scope of the disclosure. Further, various steps set forth herein may be carried out in orders that differ from those set forth herein without depart from the scope of the present methods. This specification shall not be restricted to the above embodiments.

Any units of measurement provided herein are exemplary in nature only and are not meant to specifically define the dimensions of the system. Other dimensions may be appropriate or desirable.

What is claimed is:

1. A fastening system comprising:

at least one tile having a tile surface, the tile being disposed above a subsurface; and at least one fastening mechanism, the at least one fastening mechanism comprising:

a transition member having a lower planar element, and an upper planar element, and a central portion disposed between the lower planar element and the upper planar element; and a ramp member having a lower planar component, a first upper planar component, a forwardly angled component disposed between the lower planar component and the first upper planar component, and a backwardly angled component extending outwardly from the first upper planar component;

wherein:

the ramp member lower planar member is disposed above the subsurface;

the transition member upper planar element is substantially adjacent the tile surface;

the ramp member upper planar member is disposed above the transition member upper planar element;

the transition member lower planar element is at least partially disposed above the ramp member lower planar member;

a fastener is inserted through corresponding apertures in the transition member lower planar element and the ramp member lower planar component to secure the fastening mechanism to the subsurface.

2. The fastening system of claim 1, wherein the tile is not secured to the subsurface; and wherein a first space formed between the transition member central portion and an edge of the tile permits expansion and contraction of the tile in the first space.

3. The fastening system of claim 2, further comprising a probe gauge, wherein the probe gauge is inserted through an aperture in the transition member central portion.

4. The fastening system of claim 1, wherein the ramp member further comprises a second upper planar component extending inwardly from the backwardly angled component forming a second space between the first upper planar component and the second upper planar component; and wherein the transition member upper planar element is disposed in the second space.

5. The fastening system of claim 4, wherein a slope of the forwardly angled component is approximately 1:12.

6. The fastening system of claim 1, wherein the at least one tile comprises a plurality of tiles fastened together to form a network of tiles, wherein the at least one fastening mechanism comprises a plurality of fastening mechanisms, and wherein each of the plurality of fastening mechanisms is disposed around a perimeter of the network of tiles.

7. A fastening system comprising:

at least one tile having a tile surface, the tile being disposed above a subsurface; and at least one fastening mechanism, the fastening mechanism comprising:

a transition member having a lower planar element, and an upper planar element, and an angled central portion disposed between the lower planar element and the upper planar element; and a ramp member having a lower planar component, a first upper planar component, a forwardly angled component disposed between the lower planar component and the first upper planar component, a backwardly angled component extending outwardly from the first upper planar component, and a second upper planar component extending inwardly from the backwardly angled component, a first space being formed between the first upper planar component and the second upper planar component;

wherein:

the ramp member lower planar component is disposed above the sub surface;

the transition member upper planar element is disposed in the first space; and the transition member lower planar element is at least partially disposed above the ramp member lower planar member.

8. The fastening system of claim 7, wherein the tile is not secured to the subsurface; and wherein a second space formed between the transition member central portion and an edge of the tile permits expansion and contraction of the tile in the second space.

9. The fastening system of claim 8, further comprising a probe gauge, wherein the probe gauge is inserted through an aperture in the transition member central portion.

10. The fastening system of claim 8, wherein the at least one fastening mechanism imparts an elastic force on the tile, the force causing the second upper planar component and an end of the backwardly shaped component to press against the tile surface.

11. The fastening system of claim 7, wherein a fastener is inserted through corresponding apertures in the transition member lower planar element and the ramp member lower planar component to secure the at least one fastening mechanism to the subsurface, the fastener being covered by the ramp member upper planar component.

12. The fastening system of claim 7, wherein the at least one tile comprises a plurality of tiles fastened together to form a network of tiles, wherein the at least one fastening mechanism comprises a plurality of fastening mechanisms, and wherein each of the plurality of fastening mechanisms is disposed around a perimeter of the plurality of tiles.

* * * * *